US012342915B2

(12) United States Patent
Moon

(10) Patent No.: US 12,342,915 B2
(45) Date of Patent: Jul. 1, 2025

(54) SNAP-FIT SUITCASE

(71) Applicant: Jerry Moon, Taipei (TW)

(72) Inventor: Jerry Moon, Taipei (TW)

( * ) Notice: Subject to any disclaimer, the term of this patent is extended or adjusted under 35 U.S.C. 154(b) by 96 days.

(21) Appl. No.: 18/345,656

(22) Filed: Jun. 30, 2023

(65) Prior Publication Data

US 2025/0000222 A1 Jan. 2, 2025

(51) Int. Cl.

| | |
|---|---|
| ***A45C 5/03*** | (2006.01) |
| ***A45C 13/04*** | (2006.01) |
| ***A45C 13/10*** | (2006.01) |
| ***A45C 13/36*** | (2006.01) |

(52) U.S. Cl.

CPC ..... *A45C 5/03* (2013.01); *A45C 13/04* (2013.01); *A45C 13/103* (2013.01); *A45C 13/36* (2013.01); *A45C 2005/037* (2013.01)

(58) Field of Classification Search

CPC ..... A45C 5/03; A45C 13/04; A45C 13/103; A45C 13/26; A45C 2005/037

USPC ..... 190/121

See application file for complete search history.

(56) References Cited

U.S. PATENT DOCUMENTS

| | | | | |
|---|---|---|---|---|
| 9,155,369 | B2 * | 10/2015 | Santy | A45C 13/04 |
| 11,814,234 | B1 * | 11/2023 | Moon | B65D 81/3813 |
| 2024/0130499 | A1 * | 4/2024 | Moon | A45C 13/103 |

* cited by examiner

*Primary Examiner* — Sue A Weaver

(74) *Attorney, Agent, or Firm* — Rabin & Berdo, P.C.

(57) ABSTRACT

A snap-fit suitcase includes two shell structures respectively having a case member removably snap-fitted onto a frame member; two lining structures respectively being removably snap-fitted onto the frame members and located in the case members; and a zipper structure having two zipper tapes and a slider. The zipper tapes respectively include a plurality of embedding teeth, which are embedded in the frame members; and the slider is used to close a plurality of closure teeth on one zipper tape to a plurality of closure teeth on the other zipper tape. With these arrangements, both the case members and the lining structures can be snap-fitted onto the frame members to not only largely shorten the time for assembling the suitcase, but also enable easy disassembling of the case members, the frame member and the lining structures to facilitate convenient repair and maintenance of the suitcase.

15 Claims, 18 Drawing Sheets

SNAP-FIT SUITCASE

FIELD OF THE INVENTION

The present invention relates to a suitcase that does not include any sewing process, and more particularly, to a snap-fit suitcase that includes case members, frame members and lining structures, which are assembled through snap-fit.

BACKGROUND OF THE INVENTION

A suitcase is generally carried by a user during a holiday trip or a sightseeing travel abroad for holding personal things. Presently, there are various kinds of suitcases available in the market featured by different functions and designs to satisfy users' increasing demands. Most of the present suitcases mainly include two shells respectively having a case member and a lining fixed to an inner side of the case member. Further, most of the currently available suitcases are zipper suitcases, which respectively include two shells connected to each other via a zipper, so that the two shells can be selectively opened or closed.

The zipper suitcase usually has its linings and zipper sewed onto the case members. Therefore, the case members, the linings, and the zipper could not be assembled conveniently and increased time is required to assemble the linings and the zipper to the case members. In the case the linings are sewn to the case members, a user could not easily detach or replace the linings for cleaning or repair when the linings are dirty or broken.

SUMMARY OF THE INVENTION

A primary object of the present invention is to provide an improved suitcase structure, in which two shell structures, two lining structures and a zipper structure are assembled through snap-fit instead of sewing, so that the assembling time of the suitcase is largely shortened.

To achieve the above and other objects, the snap-fit suitcase according to the present invention includes two shell structures, two lining structures, and a zipper structure.

Each of the two shell structures includes a frame member and a case member. The frame member has an enclosed frame, and an edge of the enclosed frame is extended to form an inner stop wall and an outer stop wall. The inner stop wall is spaced from the outer stop wall, such that an insertion space is defined between the inner stop wall, the outer stop wall and the enclose frame. The enclosed frame is provided on an inner side with a plurality of lining retaining hooks, and the outer stop wall has an inner side surface provided with a plurality of stop protrusions. The case member includes a bottom plate portion, a surrounding wall portion, and a case internal space defined between the bottom plate portion and the surrounding wall portion; and the surrounding wall portion of the case member is provided with a plurality of retaining holes corresponding to the stop protrusions on the outer stop wall of the frame member. The surrounding wall portion is designed for extending into the insertion space on the frame member, such that the inner stop wall is located in the case internal space of the case member and the stop protrusions on the inner side surface of the outer stop wall are aligned with and enter the retaining holes on the surrounding wall portion in one-to-one correspondence.

Each of the two lining structures includes a lining main body and a lining spline. The lining spline is wrapped in an edge of the lining main body to be connected to the lining main body and located in the case internal space. The lining spline is removably snap-fitted in the lining retaining hooks on the enclosed frame of the shell structure.

The zipper structure includes two zipper tapes respectively connected to one of the two shell structures and a slider for closing or separating the two zipper tapes. The zipper tapes are provided along their two facing edges with a plurality of embedding teeth each, which are embedded in the enclosed frames, and along their two opposed edges with a plurality of closure teeth each, which are exposed from the shell structures, such that the two shell structures are connected to each other by closing the closure teeth on the two zipper tapes.

In a preferred embodiment, on each of the shell structures, the outer stop wall is deformable relative to the enclosed frame. The surrounding wall portion of the case member, when being extended into the insertion space, is adapted to press against and push the stop protrusions to displace, and the stop protrusions cause the outer stop wall to deform in a direction away from the inner stop wall.

Further, one side of each of the stop protrusions facing away from the outer stop wall is formed into a slanted stop protrusion guiding surface that is adapted to contact with the surrounding wall portion of the case member; and the surrounding wall portion of the case member is guided by the stop protrusion guiding surface to a location between the stop protrusions and the inner stop wall, enabling the surrounding wall portion to keep moving into the insertion space. The slanted stop protrusion guiding surface has a lowermost section that is defined as a lower guiding section and an uppermost section that is defined as an upper guiding section located at a height higher than that of the lower guiding section. The lower guiding section is located in one corresponding retaining hole, and the upper guiding section is protruded beyond the corresponding retaining hole and located outside the case internal space.

The inner stop wall includes a plurality of inner wall segments spaced along the enclosed frame, such that a division space is formed between any two adjacent inner wall segments. The division spaces are located in one-to-one correspondence to the stop protrusions and the upper guiding sections are respectively located in one corresponding division space. A portion on each of the stop protrusion guiding surfaces is sunken to form a stop protrusion recess for communicating with the insertion space.

The enclosed frame further includes a stop strip located above the lining retaining hooks, such that a clamp space is formed between the stop strip and the lining retaining hooks; and the stop strip and the lining retaining hooks together limit the lining spline in the clamp space. The stop strip has a width larger than a length of the lining retaining hook; the stop strip is formed with a plurality of through holes, and the through holes respectively have a profile larger than that of the lining retaining hook and are located in one-to-one correspondence to the lining retaining hooks.

The snap-fit suitcase according to the present invention further includes a shield structure, the shield structure includes a shield cover and a plurality of shield hooks provided on the shield cover. A first part of the shield hooks is snap-fitted onto the enclosed frame of one of the two frame members while a second part of the shield hooks is snap-fitted onto the enclosed frame of the other frame member, such that the shield cover is adapted to cover part of the zipper tapes.

The shield cover includes two assembling sections that spacing each other parallelly and a bendable section extended between and connected to the two assembling sections. The first part of the shield hooks is formed on one of the two assembling sections while the second part of the shield hooks is formed on the other assembling section. The bendable section is deformable to thereby allow change of a position of one assembling section relative to the other assembling section. The enclosed frames are symmetrically formed on an outer side at a predetermined location with a shield receiving recess for receiving the assembling sections of the shield covers therein; and the shield receiving recesses have a depth larger than or equal to a thickness of the assembling sections, such that the assembling sections are located lower than or flush with the outer side of the enclosed frames.

The shield receiving recesses on the enclosed frames have a plurality of hook receiving holes that extending through the enclosed frames. The shield hooks respectively include an extension section located in a corresponding one of the hook receiving holes and a snap-fit section extended from and located perpendicular to a distal end of the extension section. The snap-fit sections are projected beyond the hook receiving holes and then dislocated from the hook receiving holes to thereby contact with the inner side of the enclosed frames.

The extension section of the shield hook is deformable relative to the shield cover. When the shield hook is extended into the hook receiving hole, the snap-fit section of the shield hook is pressed against the outer side of the enclosed frame to cause deformation of the extension section; and the deformed extension section enables the snap-fit section to move to an inner side of the hook receiving hole. The snap-fit section of the shield hook includes a hook guiding surface, and the shield hook is guided by the hook guiding surface into the hook receiving hole.

In the present invention, the frame members are integrally formed on the embedding teeth of the zipper tapes through plastic insert molding.

The present invention is characterized in that the zipper tapes of the zipper structure are embedded in the frame members of the shell structures. More specifically, the frame members respectively enclose the embedding teeth on a corresponding one of the zipper tapes, so that the corresponding zipper tape and frame member form an integral unit. The present invention is also characterized in that both the lining structures and the case members of the shell structures can be removably snap-fitted onto the frame members, enabling the case members and the lining structures to be assembled to the frame members with shortened time. Further, since the case members and the lining structures all are snap-fitted onto the frame members, it is easy to disassemble the case members, the frame members and the lining structures from one another to facilitate convenient repair or maintenance of the suitcase.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

To further understand more detail of the structure, usage and features of the present invention, it will now be described with a preferred embodiment thereof and with reference to the accompanying drawings.

Figure 1:
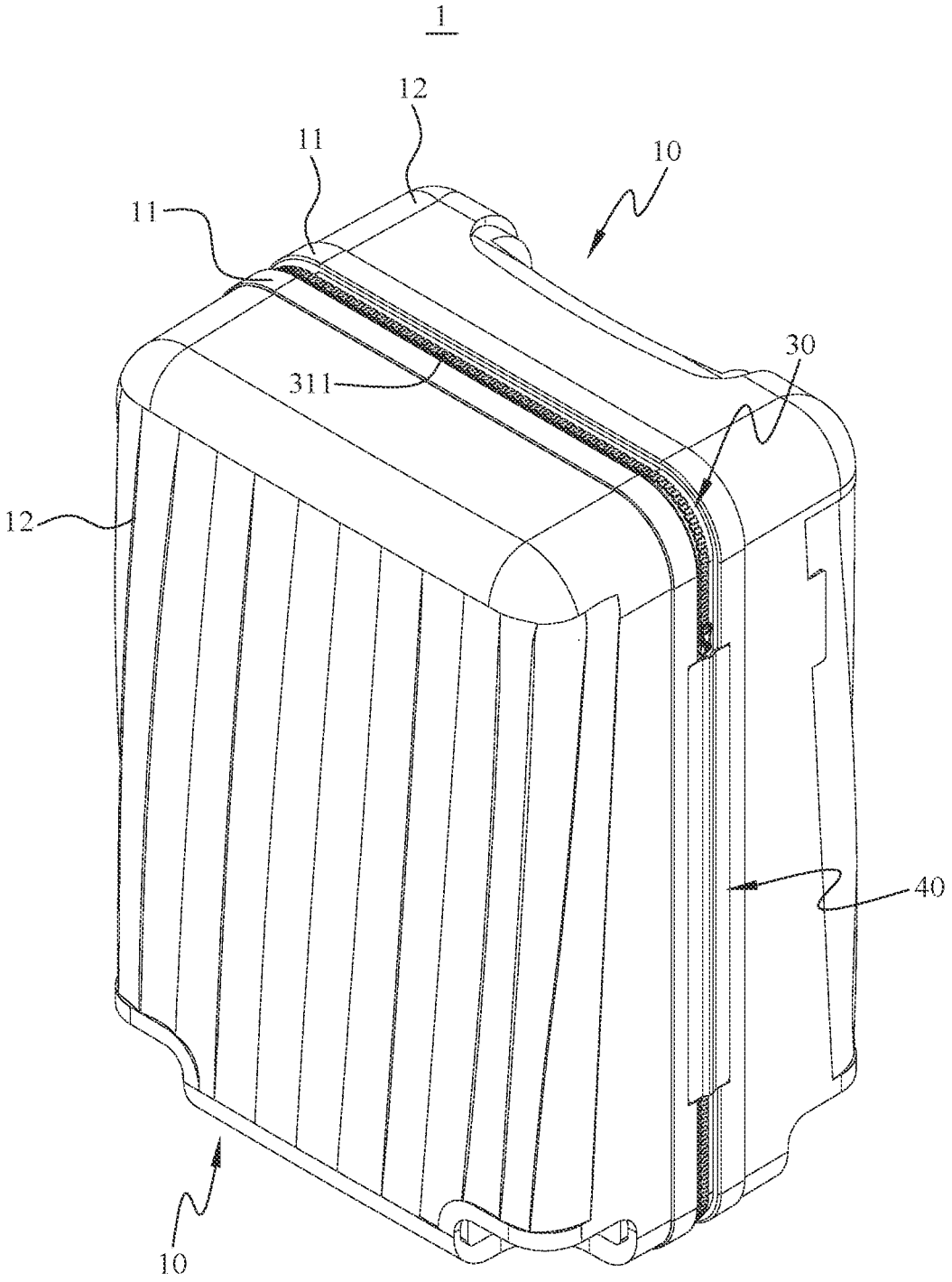
FIG. 1 is a perspective view of a snap-fit suitcase according to a preferred embodiment of the present invention.
Figure 2:
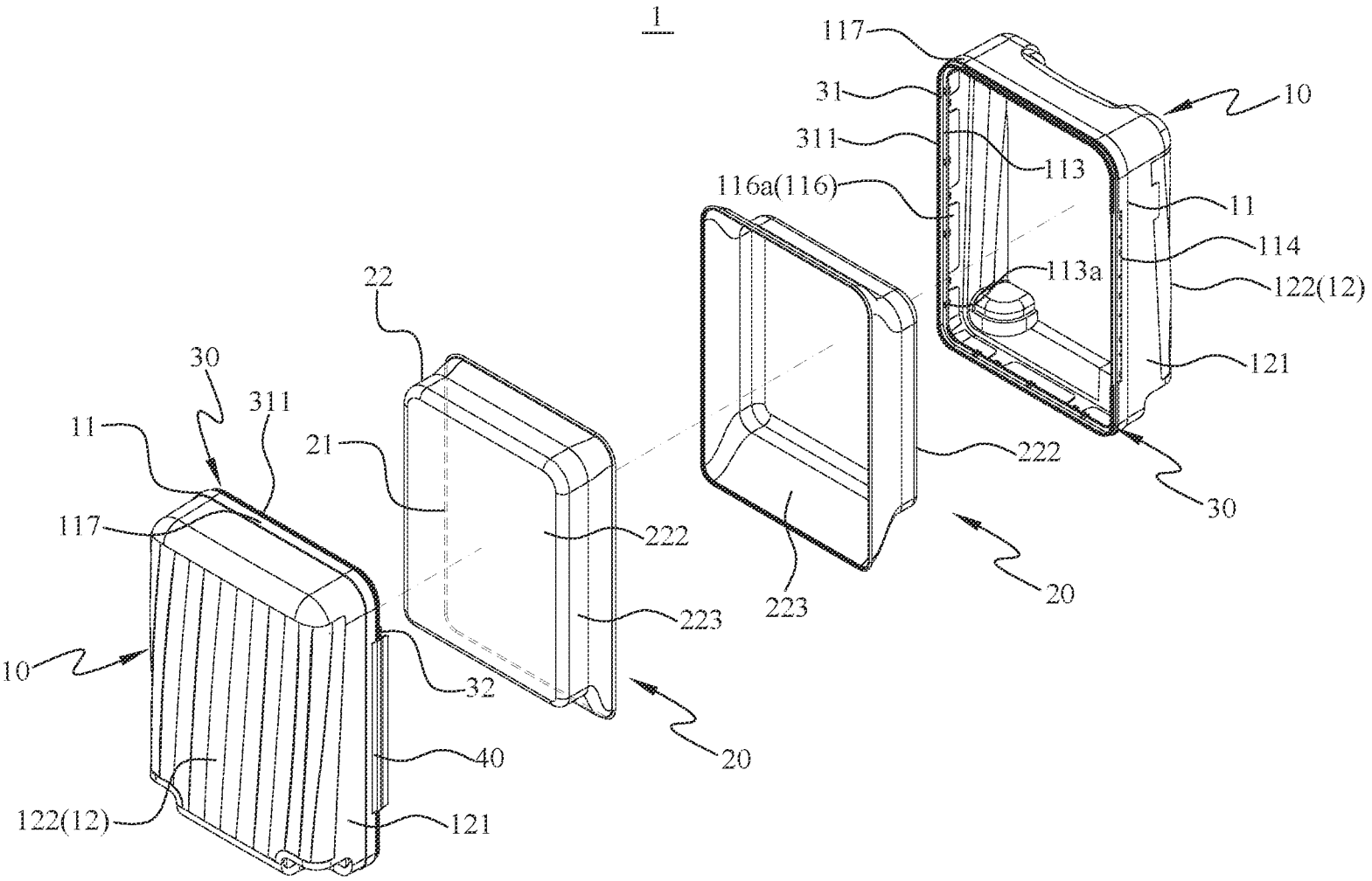
FIG. 2 is an exploded perspective view of the snap-fit suitcase of FIG. 1.
Figure 3:
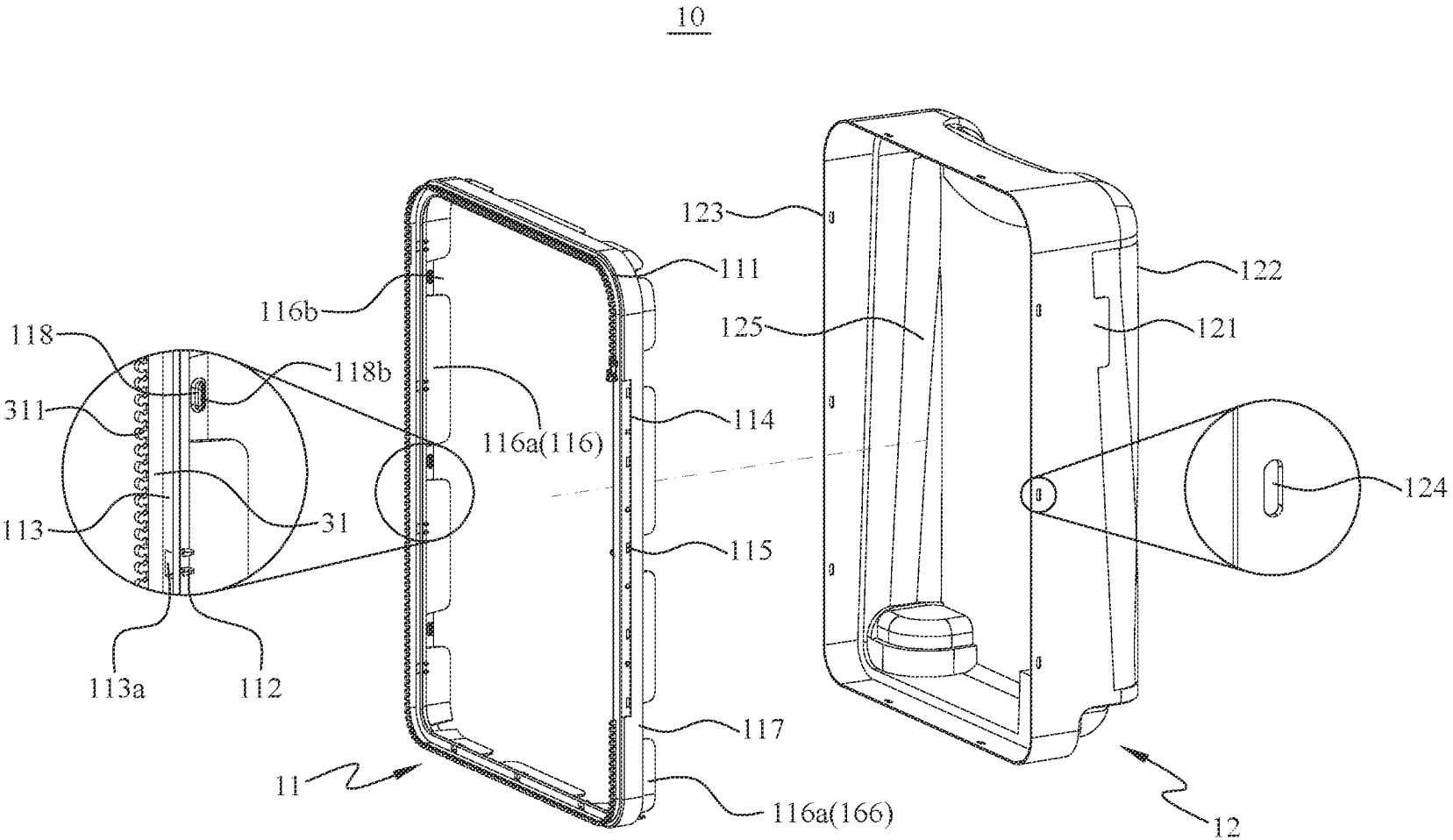
FIG. 3 is an exploded perspective view of a shell structure of the snap-fit suitcase of FIG. 1 with a zipper structure connected thereto.
Figure 4:
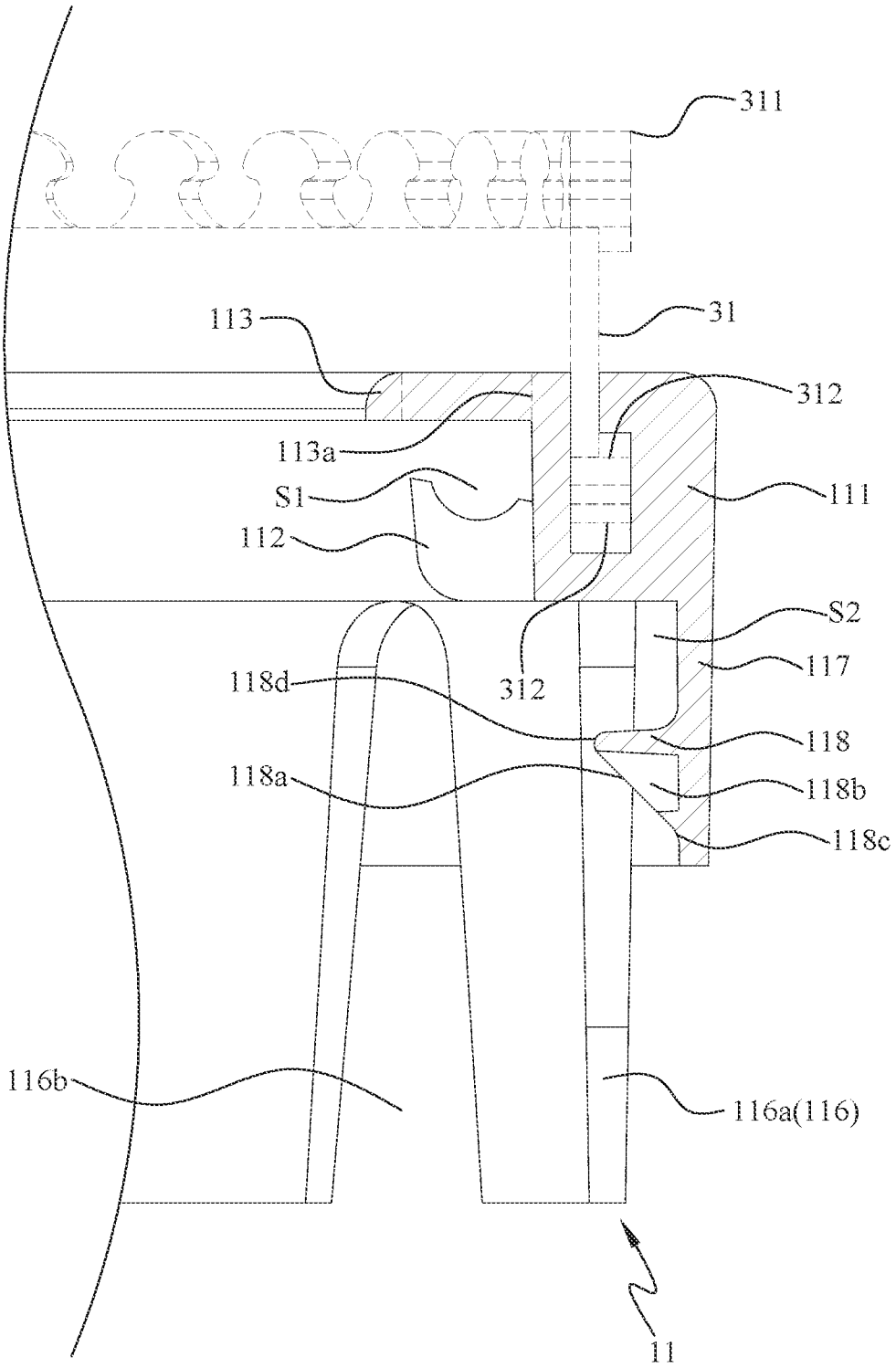
FIG. 4 is a fragmentary sectional view of a frame member of the shell structure of the snap-fit suitcase of FIG. 1.
Figure 5:
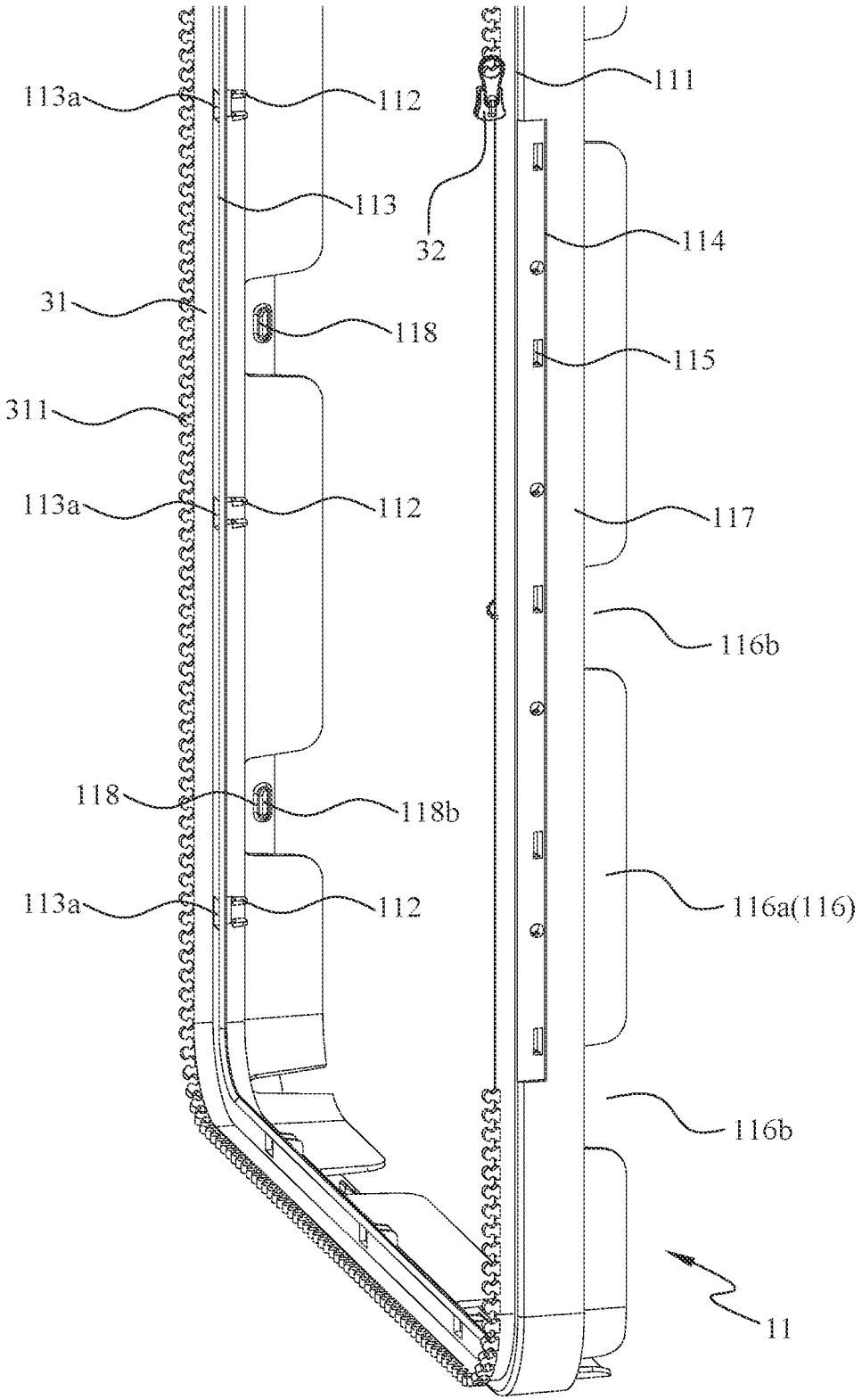
FIG. 5 is a fragmentary perspective view of the frame member of FIG. 4.

Please refer to FIGS. 1 and 2. A snap-fit suitcase 1 of the present invention includes two shell structures 10, two lining structures 20, a zipper structure 30, and a shield structure 40. As shown in FIGS. 2, 3 and 4, each of the two shell structures 10 includes a frame member 11 and a case member 12. The frame member 11 includes an enclosed frame 111 integrally formed with the zipper structure 30. The enclosed frame 111 has an inner side, on which a plurality of lining retaining hooks 112 and a stop strip 113 are provided. The stop strip 113 is located above the lining retaining hooks 112 and has a width larger than a length of the lining retaining hook 112, such that a clamp space S1 is formed between the stop strip 113 and the lining retaining hooks 112. Further, the stop strip 113 is formed with a plurality of through holes 113*a*, which respectively have a profile larger than that of the lining retaining hook 112 and are communicable with the clamp space S1. The through holes 113*a* on the stop strip 113 are located in one-to-one correspondence to the lining retaining hooks 112. Please refer to FIG. 5. The enclosed frame 111 further has an outer side, on a predetermined location of which, a rectangular shield receiving recess 114 is formed. In the shield receiving recess 114, a plurality of hook receiving holes 115 is formed to extend through the enclosed frame 111, as can be seen in FIGS. 3 and 5. Further, the enclosed frame 111 is extended from an edge thereof to form an inner stop wall 116, which is located closer to the lining retaining hooks 112, and an outer stop wall 117, which is located around and spaced from the inner stop wall 116, such that an insertion space S2 is formed on the enclosed frame 111 between the inner stop wall 116 and the outer stop wall 117, allowing the outer stop wall 117 to deform relative to the enclosed frame 111. The outer stop wall 117 is provided on an inner side surface thereof with a plurality of stop protrusions 118, which are protruded toward the insertion space S2.

Please refer to FIGS. 3 and 4. In the illustrated preferred embodiment, the inner stop wall 116 of the frame member 11 is formed of a plurality of inner wall segments 116*a*, which are spaced along the profile of the enclosed frame 111 of the frame member 11, such that a division space 116*b* is formed between any two adjacent inner wall segments 116*a* to communicate with the insertion space S2, and the division spaces 116*b* are located in one-to-one correspondence to the stop protrusions 118. One side of each stop protrusion 118 facing away from the outer stop wall 117 is formed into a slanted stop protrusion guiding surface 118*a*, and a portion of the stop protrusion guiding surface 118*a* is sunken toward the outer stop wall 117 to form a stop protrusion recess 118*b*, which is also communicable with the insertion space S2. The slanted stop protrusion guiding surface 118*a* has a lowermost section that is defined as a lower guiding section 118*c* and an uppermost section that is defined as an upper guiding section 118*d*. And, the upper guiding sections 118*d* are respectively located in one corresponding division space 116*b*.

Please refer to FIGS. 2 and 3. The case member 12 of the shell structure 10 includes a surrounding wall portion 121 and a rectangular bottom plate portion 122. The surrounding wall portion 121 has an end defining a case opening 123 and has a plurality of retaining holes 124 formed near the case opening 123 to extend through the surrounding wall portion 121. The bottom plate portion 122 is connected to another end of the surrounding wall portion 121 to space from the case opening 123, such that the surrounding wall portion 121 and the bottom plate portion 122 together define a case internal space 125 between them. The case internal space 125 communicates with not only the retaining holes 124 but also the case opening 123.

Figure 6A:
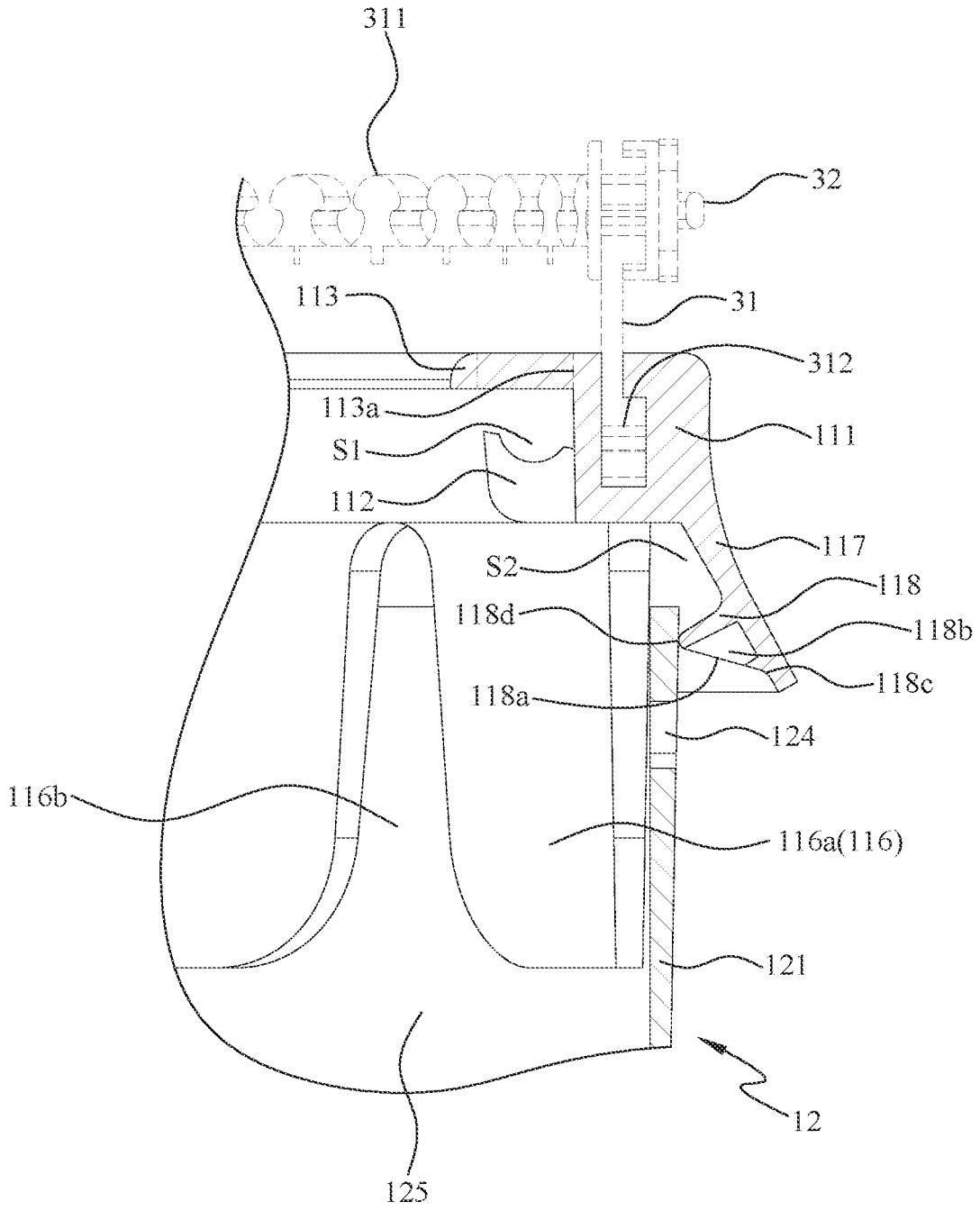
FIG. 6A is a fragmentary sectional view showing how a case member of the shell structure of the snap-fit suitcase of FIG. 1 is extended into an insertion space S2 formed on the frame member.
Figure 6B:
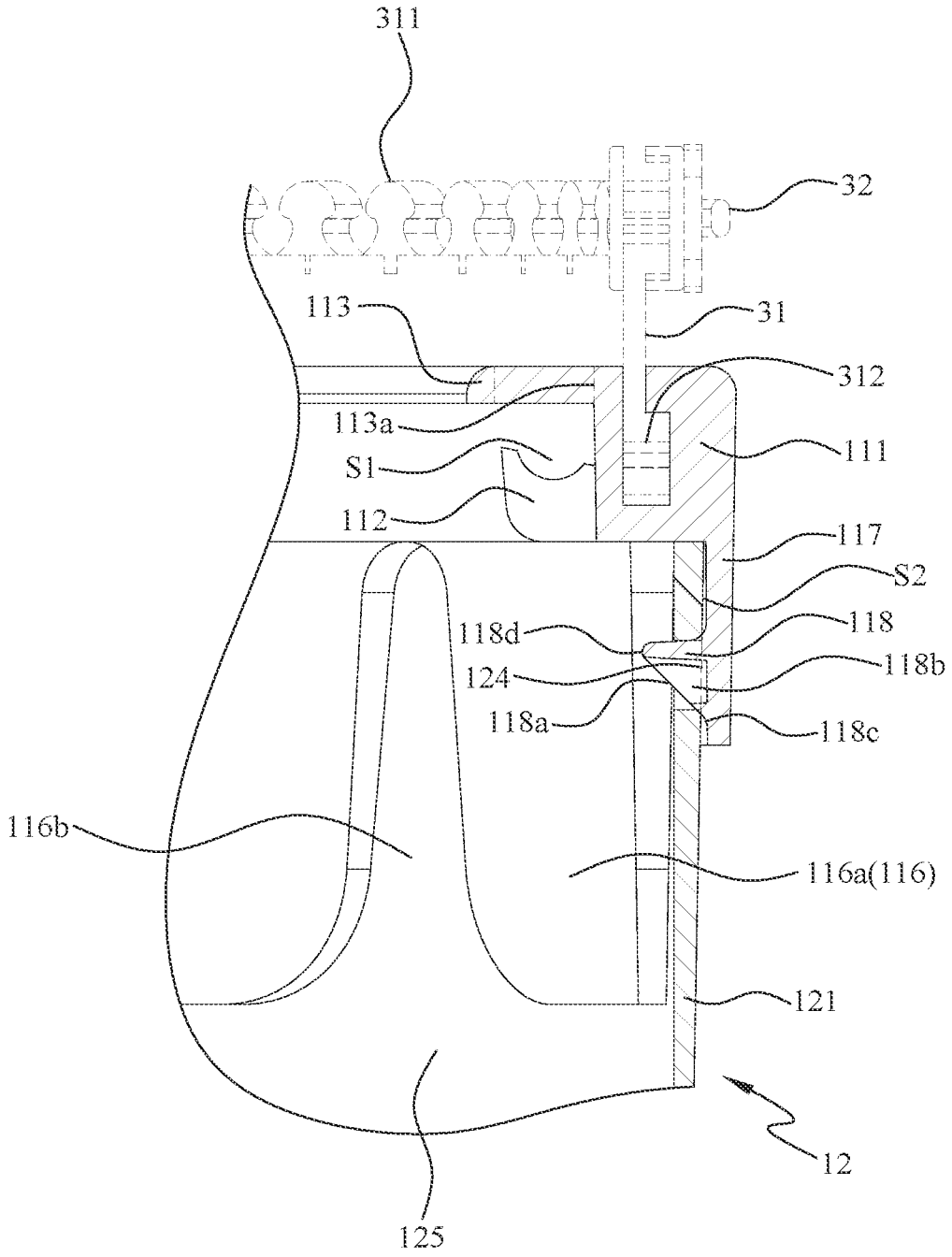
FIG. 6B shows a stop protrusion on the frame member is engaged with a retaining hole on the case member.

Please refer to FIG. 6A. The surrounding wall portion 121 of the case member 12 is to be extended into the insertion space S2. When doing so, the surrounding wall portion 121 would press against the stop protrusion guiding surfaces 118*a* of the stop protrusions 118 and is guided by the latter into a location between the stop protrusions 118 and the inner stop wall 116, enabling the surrounding wall portion 121 to keep moving into the insertion space S2 along the stop protrusion guiding surfaces 118*a* and approach the upper guiding sections 118*d* of the stop protrusion guiding surfaces 118*a* gradually. When the surrounding wall portion 121 is moved along the stop protrusion guiding surfaces 118*a*, the stop protrusions 118 are pushed by the surrounding wall portion 121 to displace relative to the enclosed frame 111 of the frame member 11, bringing the outer stop wall 117 to deform in a direction away from the inner stop wall 116 while the upper guiding sections 118*d* of the stop protrusion guiding surfaces 118*a* is in contact with an outer side of the surrounding wall portion 121. Please refer to FIG. 6B. When the surrounding wall portion 121 is kept moving into the insertion space S2, the retaining holes 124 on the case member 12 are located closer and closer to the stop protrusions 118. When the retaining holes 124 are aligned with the stop protrusions 118, the inner stop wall 116 is located in the case internal space 125 of the case member 12 and the outer stop wall 117 is deformed again to return to its original shape, enabling the stop protrusions 118 to engage with the retaining holes 124 in one-to-one correspondence. In the preferred embodiment, when the stop protrusions 118 are engaged with the retaining holes 124, the lower guiding sections 118*c* of the stop protrusion guiding surfaces 118*a* are located in the retaining holes 124, such that the stop protrusion guiding surfaces 118*a* respectively have a part located in the retaining holes 124. Meanwhile, the upper guiding sections 118*d* are protruded beyond the retaining holes 124 and located outside the case internal space 125.

Figure 7:
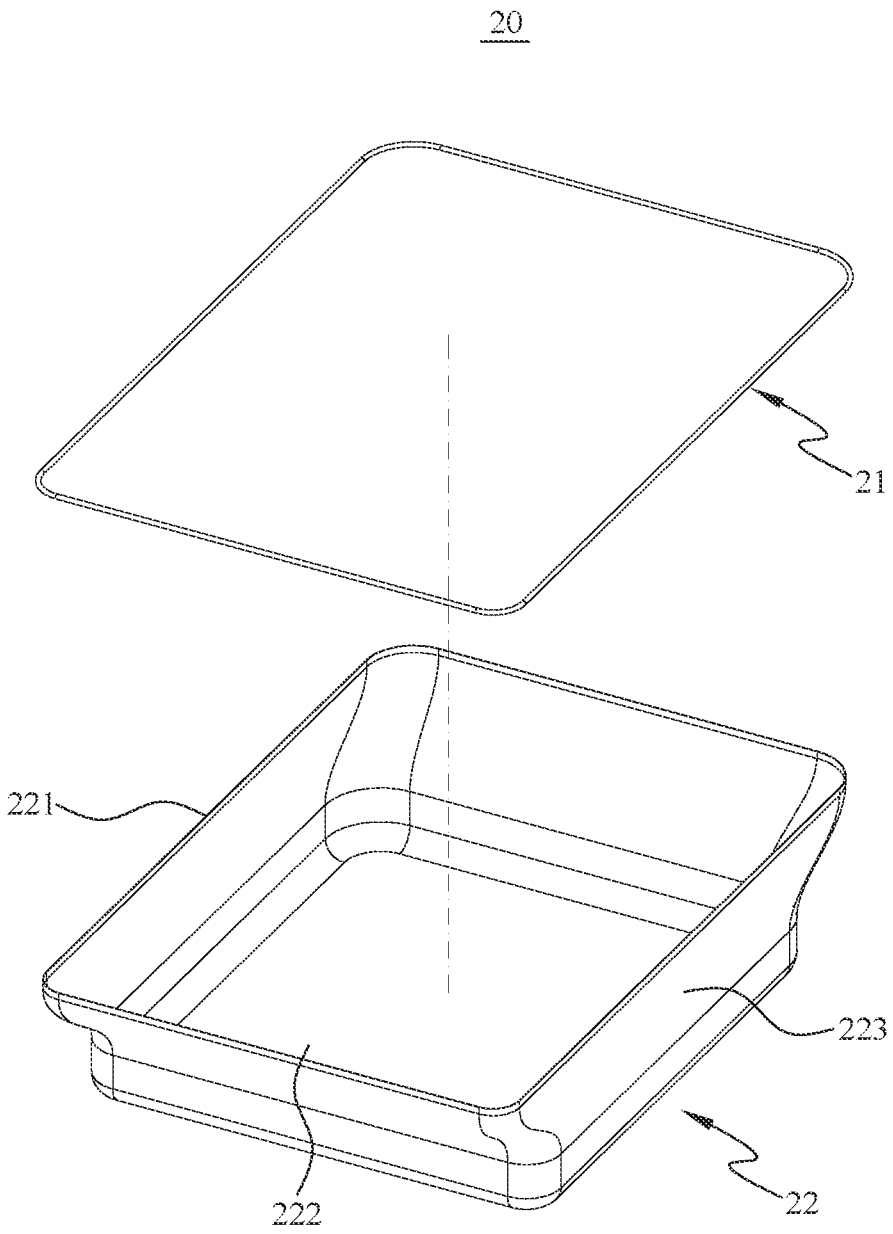
FIG. 7 is an exploded perspective view of a lining structure of the snap-fit suitcase of FIG. 1.
Figure 8:
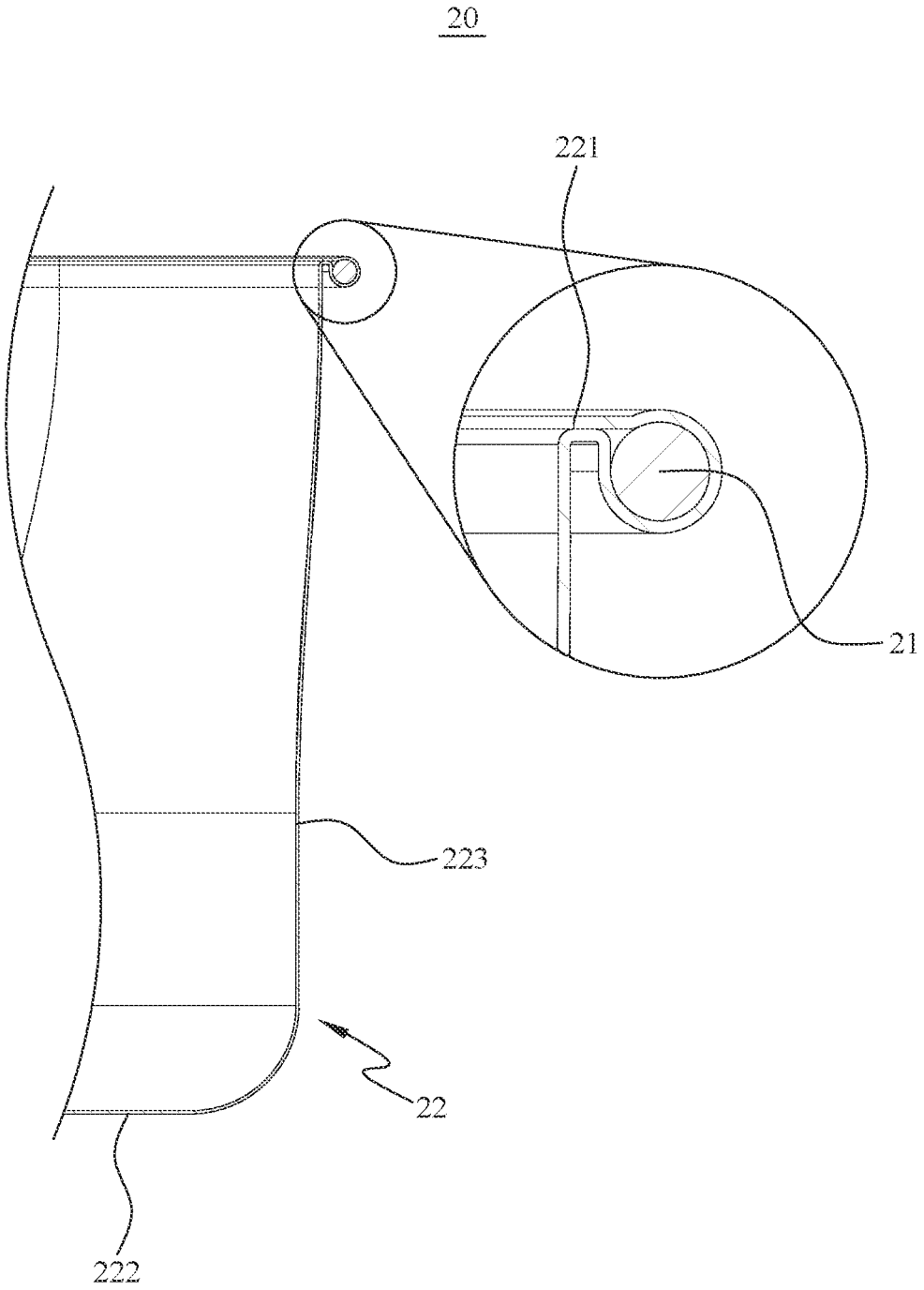
FIG. 8 is a fragmentary sectional view of the lining structure of FIG. 7.

Please refer to FIGS. 2, 7 and 8. Each of the two lining structures 20 includes a lining spline 21 formed into a loop, and a lining main body 22 made of a soft material. The lining main body 22 has two opposite ends, one of which is a lining open end 221 and the other one is a lining closed end 222 spaced from the lining open end 221. The lining main body 22 is extended from the lining open end 221 to the lining closed end 222, such that a lining sidewall 223 is formed between the lining open end 221 and the lining closed end 222. The lining open end 221 of the lining main body 22 wraps around the lining spline 21 and is sewed to the lining sidewall 223, such that the lining spline 21 is enclosed in the lining open end 221 and connected to the lining main body 22.

Figure 9A:
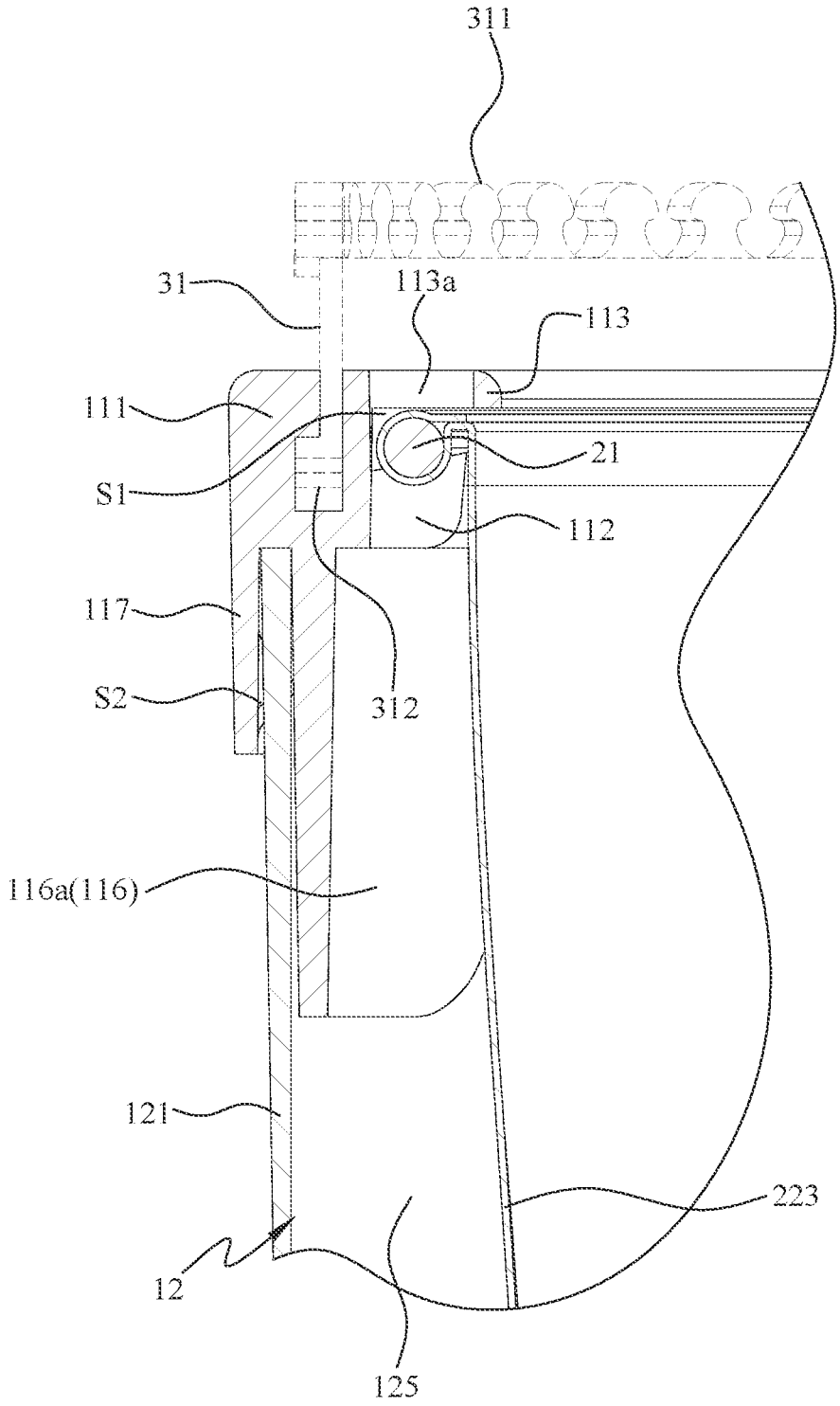
FIG. 9A is a fragmentary sectional view showing a lining spline of the lining structure of FIG. 7 is set in a lining retaining hook provided on the frame member of the snap-fit suitcase of the present invention.
Figure 9B:
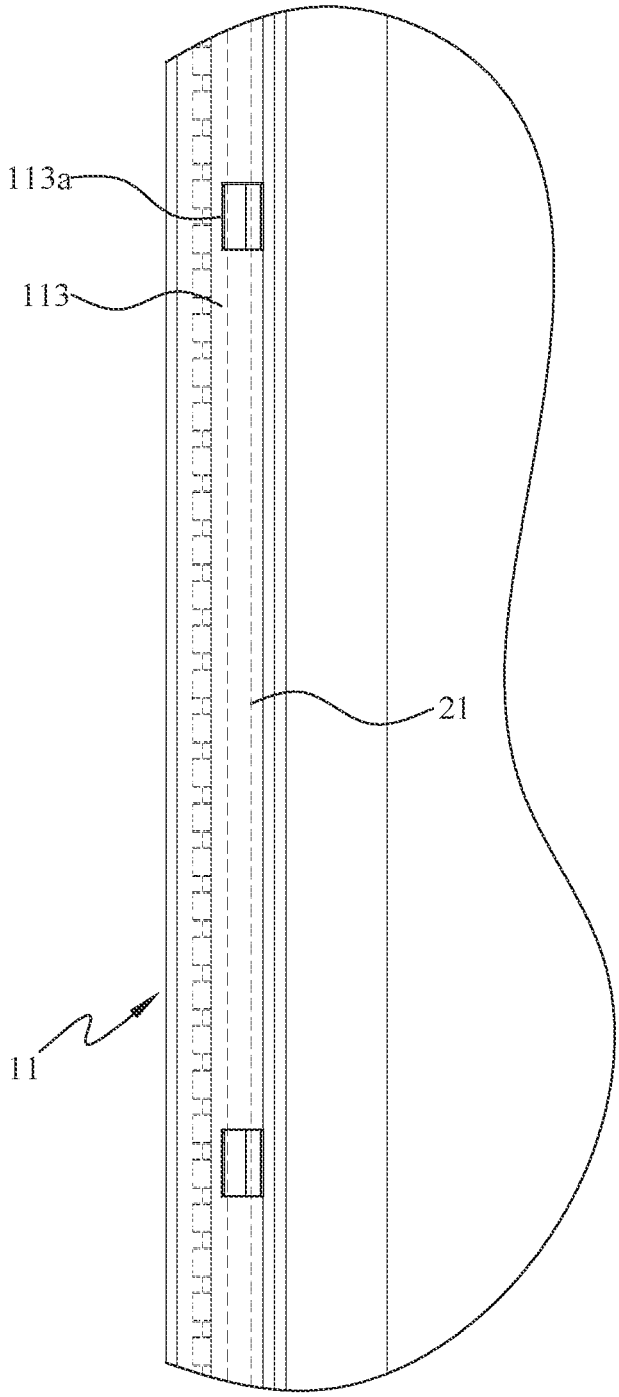
FIG. 9B is a fragmentary top view showing the use of a stop strip to cover the lining spine of the snap-fit suitcase of the present invention.

Please refer to FIGS. 9A and 9B. The lining spline 21 of the lining structure 20 is removably snap-fitted into the lining retaining hooks 112 on the frame member 11. When the lining spline 21 is engaged with the lining retaining hooks 112, the lining main body 22 is located in the case internal space 125 of the case member 12 and the lining sidewall 223 of the lining main body 22 is clamped between the lining spline 21 and the lining retaining hooks 112. At this point, the lining spline 21 is located in the clamp space S1. As can be seen in FIG. 9A, the stop strip 113 has a width larger than that of the lining spline 21. Therefore, as can be seen in FIG. 9B, the stop strip 113 covers the entire lining spline 21 when viewing from a top of the stop strip 113, and the lining retaining hooks 112 and the stop strip 113 together clamp the lining spine 21 in place in the clamp space S1.

Figure 10:
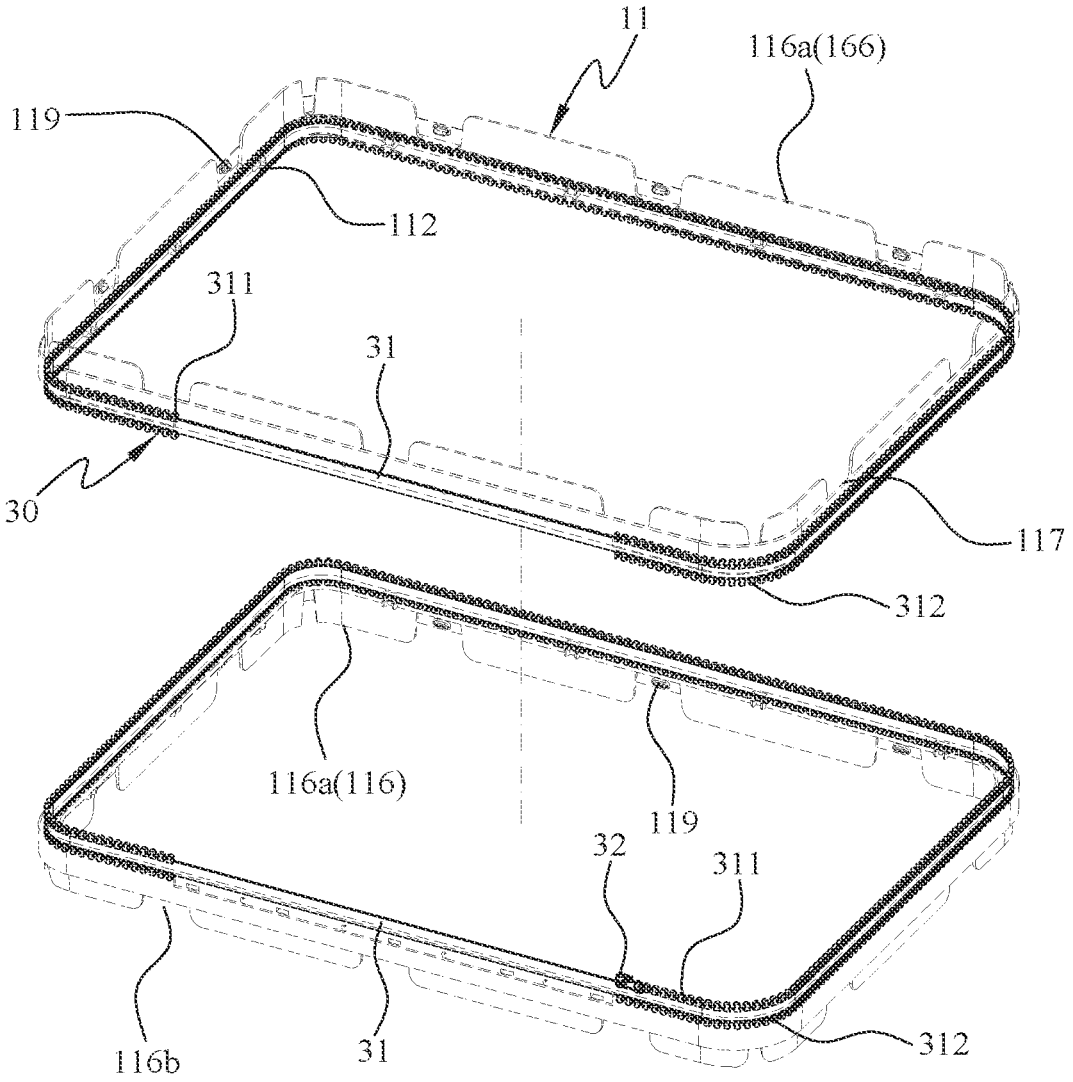
FIG. 10 is an exploded perspective view of a zipper structure of the snap-fit suitcase of the present invention.
Figure 11:
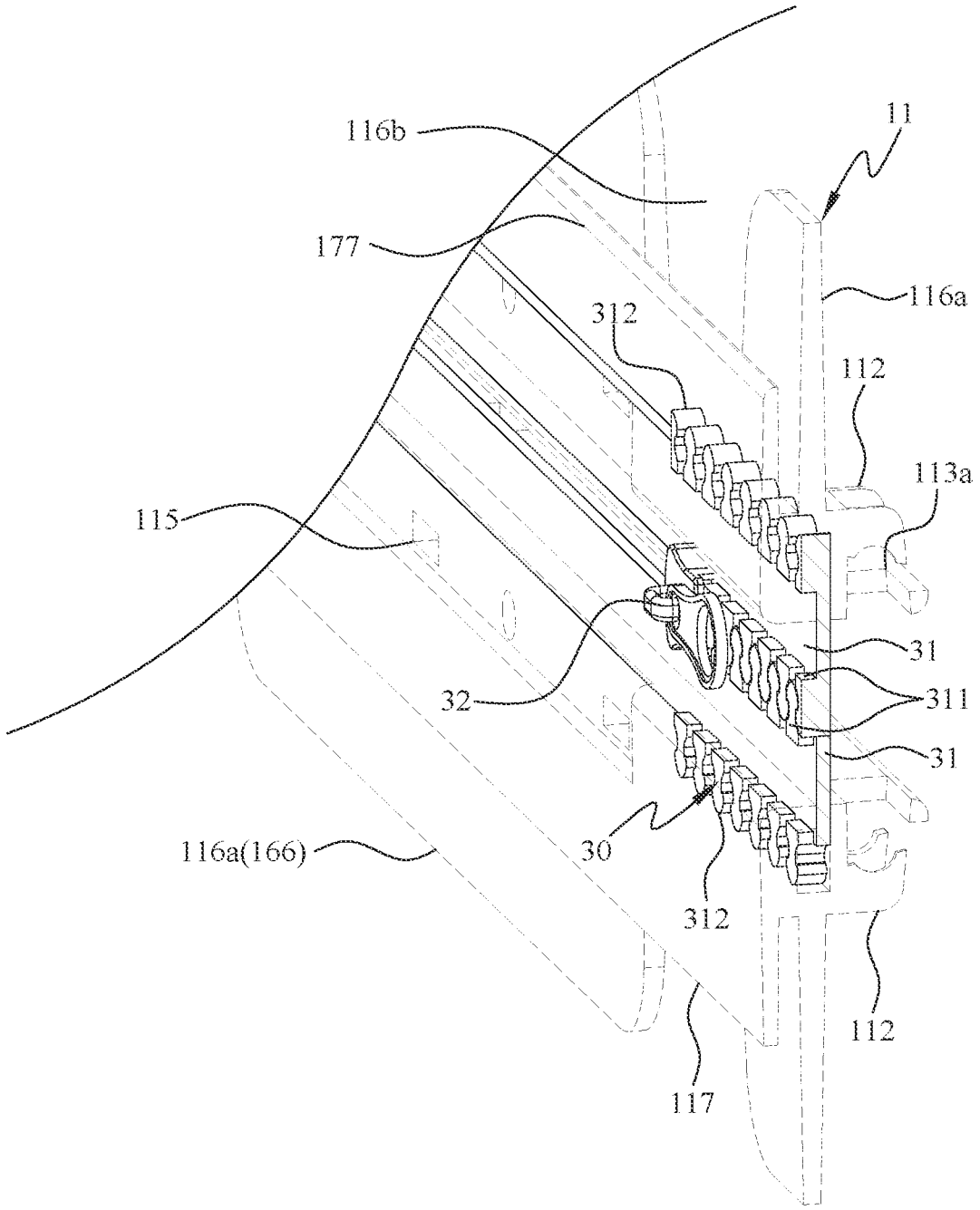
FIG. 11 is a phantom view showing the zipper structure of FIG. 10 is connected to the shell structure of the snap-fit suitcase of the present invention.

Please refer to FIGS. 2, 10 and 11. The zipper structure 30 is located between the frame members 11 of the two shell structures 10. The zipper structure 30 includes two zipper tapes 31 and a slider 32. The zipper tapes 31 are provided along their two facing edges with a plurality of spaced closure teeth 311 each and along their two opposed edges with a plurality of spaced embedding teeth 312 each. In the illustrated preferred embodiment, the frame members 11 of the shell structures 10 are integrally formed on the embedding teeth 312 of the zipper tapes 31 through insert molding. As can be seen in FIGS. 2, 10 and 11, when the frame members 11 are integrally formed on one zipper tapes 31, the embedding teeth 312 on the zipper tapes 31 are embedded in the enclosed frames 111 of the frame members 11. That is, the embedding teeth 312 on the zipper tapes 31 are wrapped in the enclosed frames 111, while the closure teeth 311 on the same zipper tapes 31 are exposed from the enclosed frames 111. The slider 32 is used to close the closure teeth 311 on one zipper tape 31 to the closure teeth 311 on the other zipper tape 31, so that the two shell structures 10 are connected to each other when the closure teeth 311 on the two zipper tapes 31 are closed.

Figure 12:
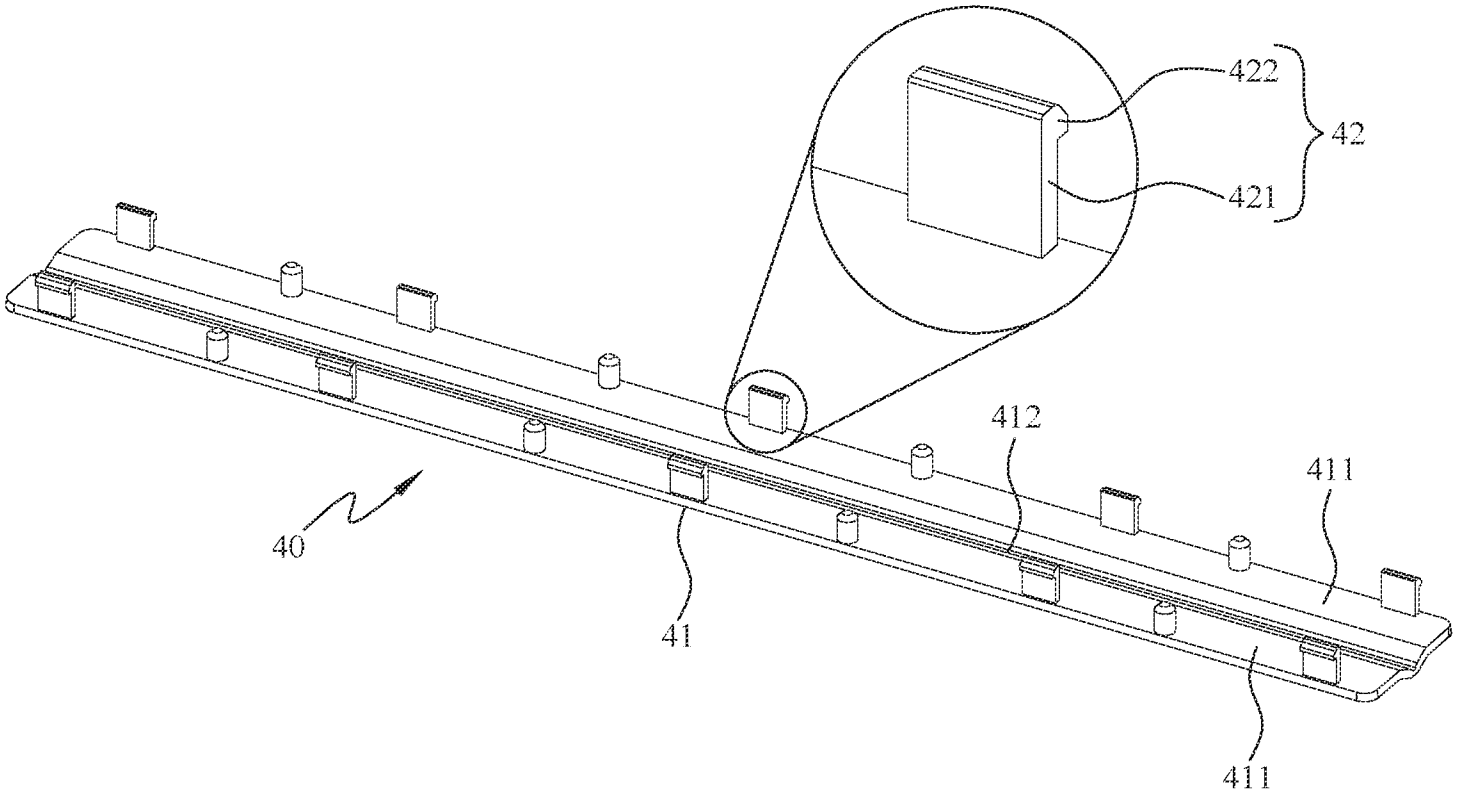
FIG. 12 is a perspective view of a shield structure of the snap-fit suitcase of the present invention.

Please refer to FIGS. 2 and 12. The shield structure 40 includes a shield cover 41 and a plurality of shield hooks 42. The shield cover 41 includes two parallelly spaced assembling sections 411 and a bendable section 412 extended between and connected to the two assembling sections 411. The assembling sections 411 respectively have a thickness smaller than a depth of the shield receiving recess 114 on the frame member 11. The bendable section 412 is deformable to thereby change the relative position of the two assembling sections 411. A first part of the shield hooks 42 are formed on one of the two assembling sections 411, while a second part of the shield hooks 42 are formed on the other assembling section 411. As can be seen in FIG. 12, each of the shield hooks 42 includes an extension section 421, which is extended from the assembling section 411, and a snap-fit section 422, which is extended from and perpendicular to a distal end of the extension section 421, such that the shield hook 42 is in the shape of a letter L. The extension section 421 is deformable relative to the assembling section 411, and the snap-fit section 422 includes a slanted hook guiding surface 422*a*.

Figure 13A:
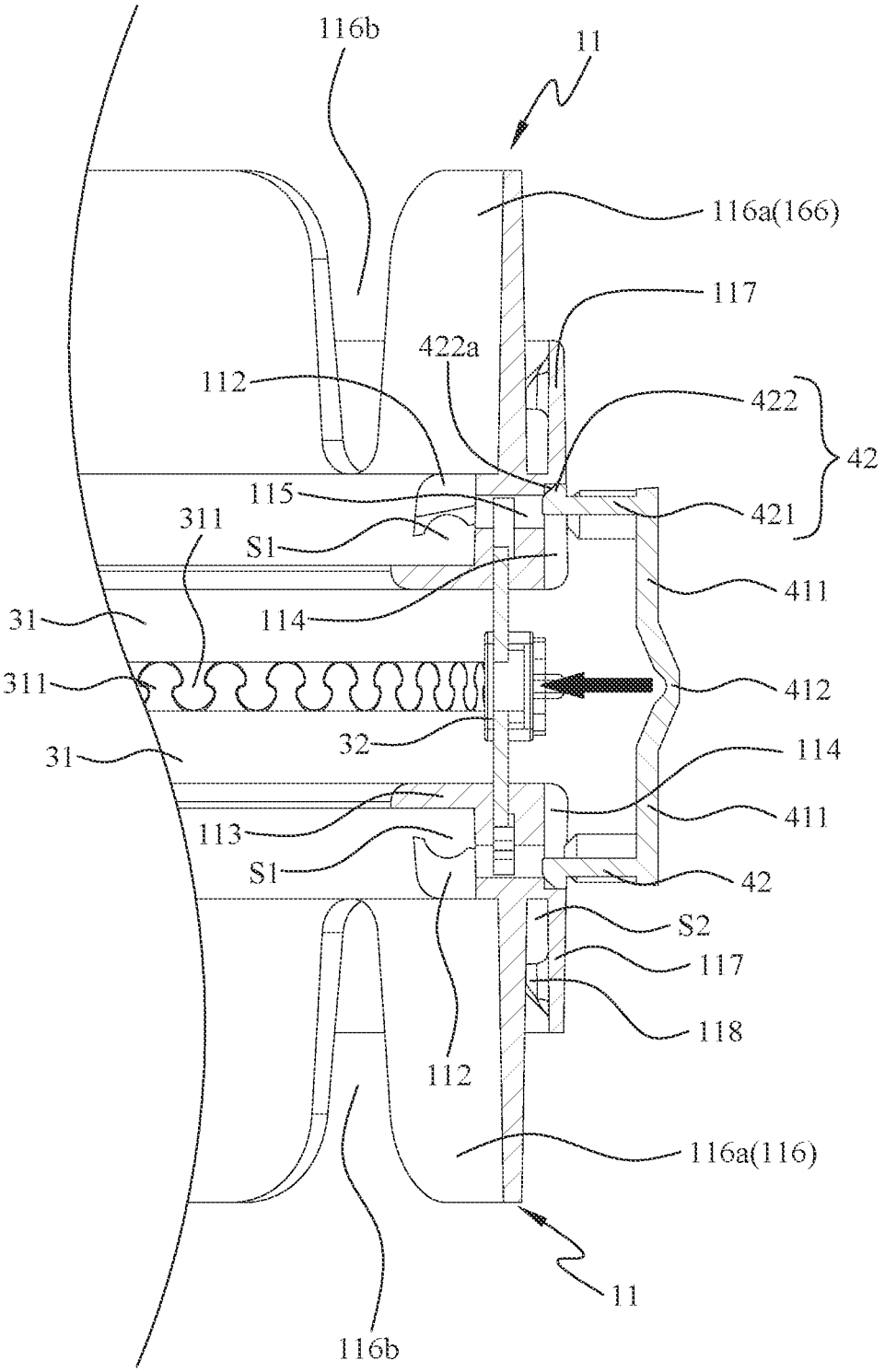
FIG. 13A is a fragmentary sectional view showing a hook guiding surface on a shield hook of the shield structure of FIG. 12 is in contact with an area surrounding a hook receiving hole.
Figure 13B:
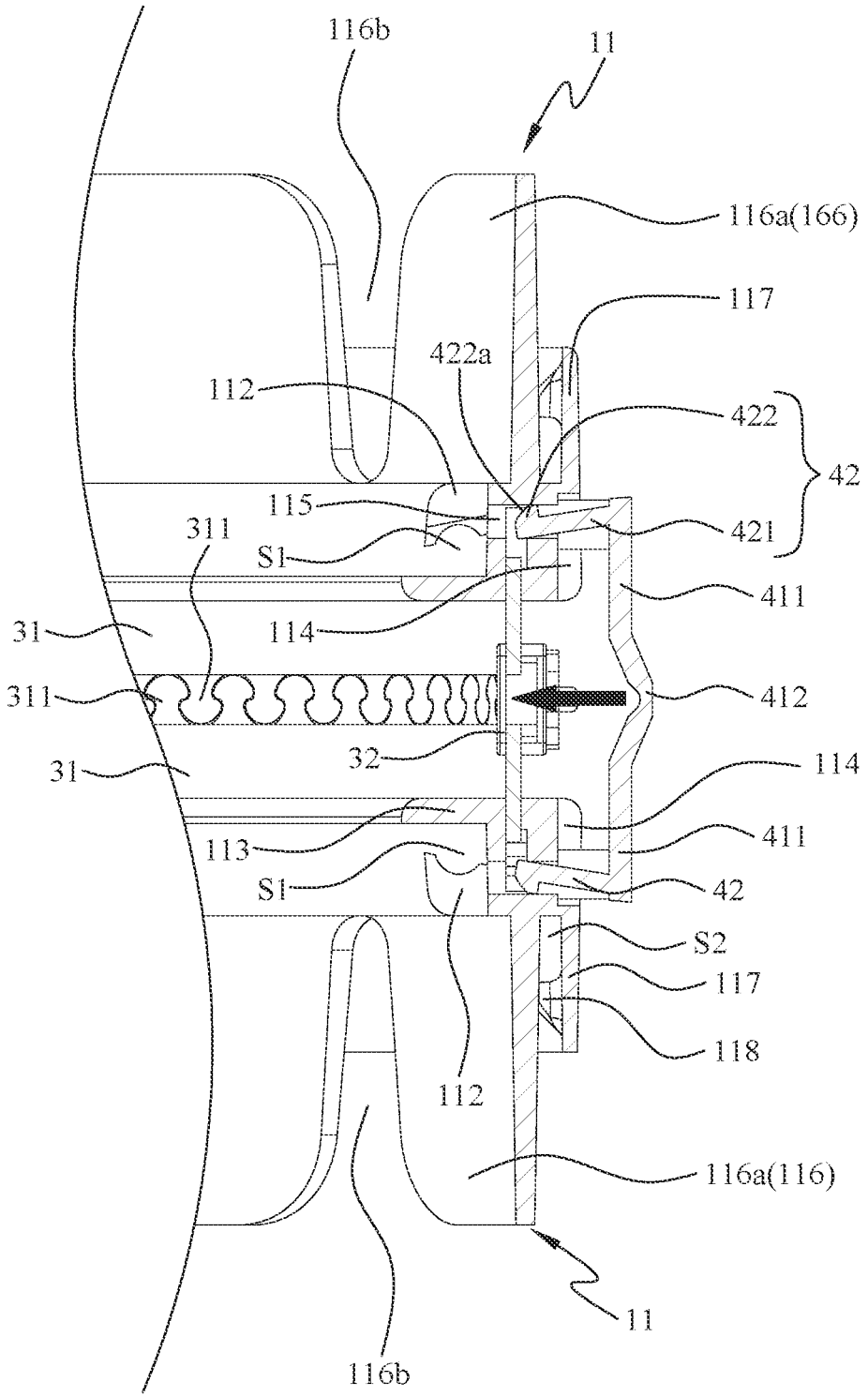
FIG. 13B shows the shield hook of the shield structure is being deformed.
Figure 13C:
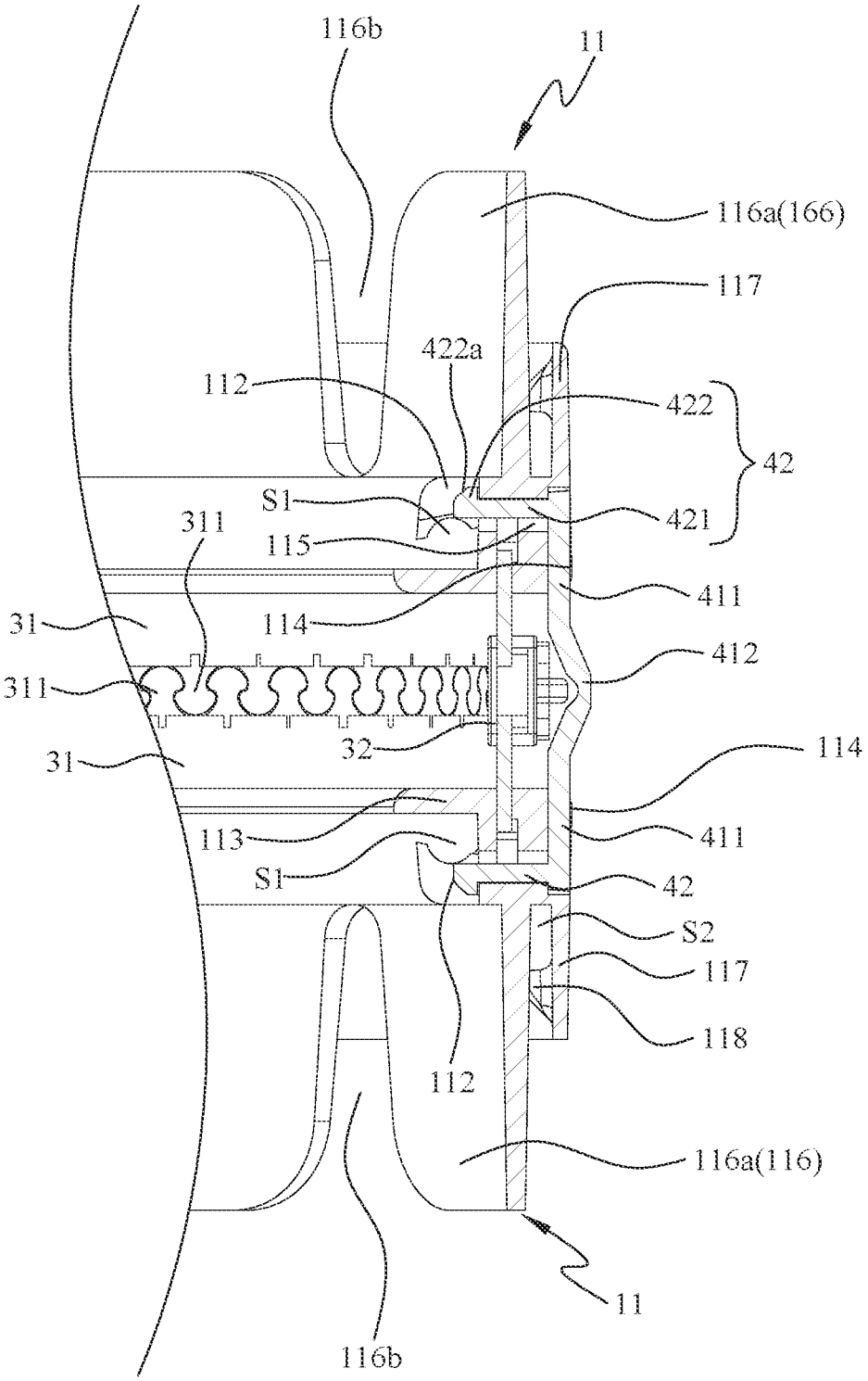
FIG. 13C shows the shield hook is joined with the frame member of the shell structure.

Please refer to FIGS. 13A to 13C. The shield structure 40 is connected to between the frame members 11 of the two shell structures 10. As shown in FIG. 13A, to connect the shield structure 40 to the shell structures 10, first place the shield structure 40 near the frame members 11 of the two shell structures 10 with the hook guiding surfaces 422*a* of the shield hooks 42 in contact with areas surrounding the hook receiving holes 115 formed in the shield receiving recesses 114 on the frame members 11. Then, as shown in FIG. 13B, keep moving the shield structure 40 closer to the frame members 11, such that the shield hooks 42 are guided by the slanted hook guiding surfaces 422*a* to move forward further. At this point, the extension sections 421 of the shield hooks 42 are deformed for both of the extension sections 421 and the snap-fit sections 422 of the shield hooks 42 to move into the hook receiving holes 115. That is, with the slanted hook guiding surfaces 422*a*, the shield hooks 42 can be guided into the hook receiving holes 115. Lastly, as shown in FIG. 13C, when the snap-fit sections 422 have been moved to project beyond the hook receiving holes 115 and be located inside the frame member 11, the extension sections 421 are allowed to return to their original profile. At this point, the snap-fit sections 422 are dislocated from the hook receiving holes 115 and in contact with the inner side of the enclosed frame 111. Meanwhile, the assembling sections 411 of the shield cover 41 are respectively set in the shield receiving recess 114 on one of the two frame members 11 with the first part of the shield hooks 42 snap-fitted onto the enclosed frame 111 of one frame member 11 and the second part of the shield hooks 42 snap-fitted onto the enclosed frame 111 of the other frame member 11. In this manner, the bendable section 412 of the shield cover 41 can cover and shield part of the zipper tapes 31. In the illustrated preferred embodiment, since the shield receiving recesses 114 have a depth larger or equal to a thickness of the assembling sections 411, the assembling sections 411 set in the shield receiving recesses 114 would not protruded from outer surfaces of the enclosed frames 111.

Figure 14:
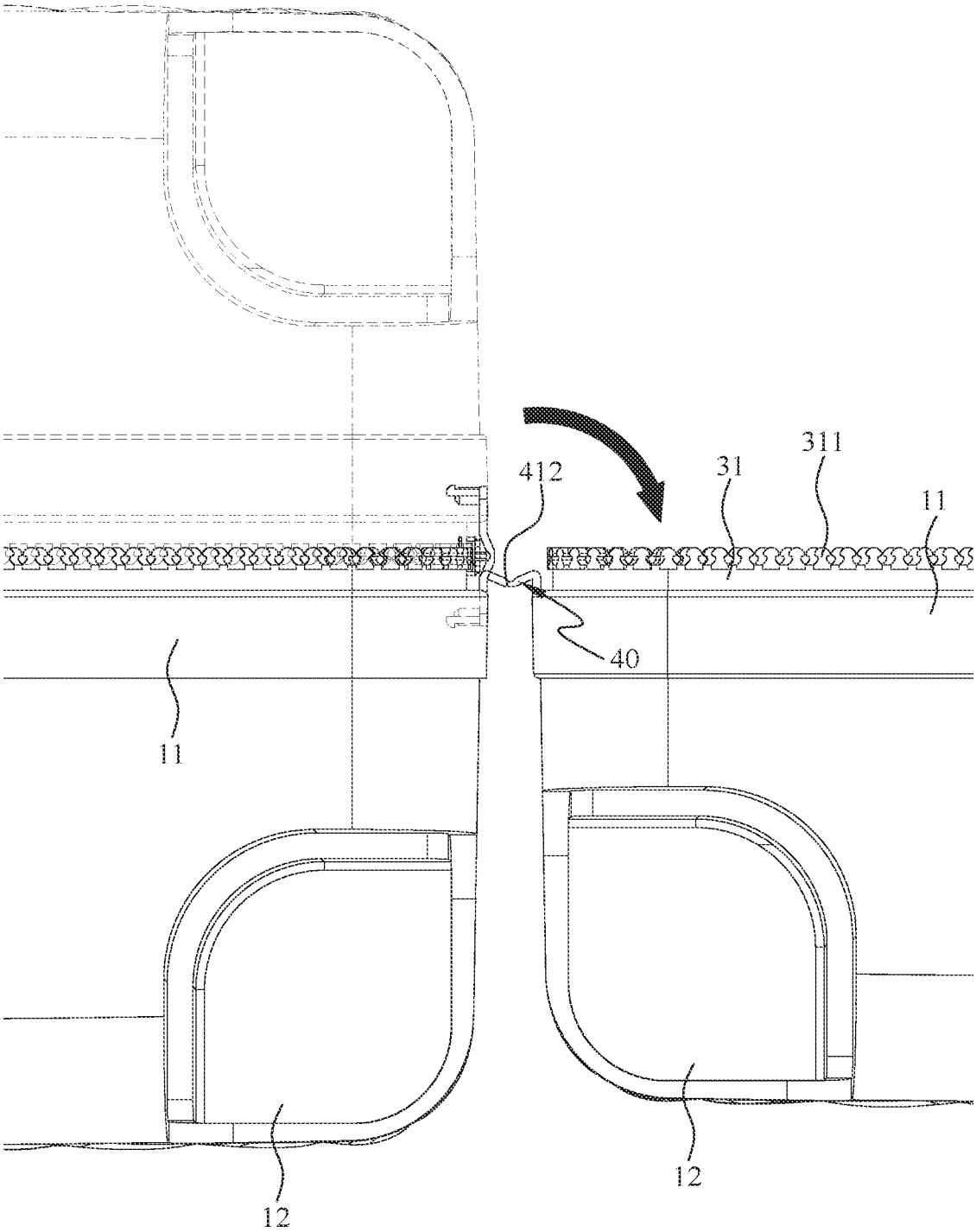
FIG. 14 shows one of the two shell structures of the snap-fit suitcase of the present invention can be pivotally turned about the shield structure relative to the other shell structure.

Please refer to FIG. 14. With the shield structure 40 connected to between the frame members 11 of the two shell structures 10, one of the two shell structures 10 can be pivotally turned about the bendable section 412 of the shield cover 41, and the bendable section 412 is deformable to allow change in the position of the pivotally turned shell structure 10 relative to the other shell structure 10.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A snap-fit suitcase, comprising:

two shell structures respectively including:

a frame member having an enclosed frame, and an edge of the enclosed frame is extended to form an inner stop wall and an outer stop wall, the inner stop wall being spaced from the outer stop wall, such that an insertion space is defined between the inner stop wall, the outer stop wall, and the enclosed frame; the enclosed frame being provided on an inner side with a plurality of lining retaining hooks; and the outer stop wall having an inner side surface provided with a plurality of stop protrusions; and a case member including a bottom plate portion, a surrounding wall portion, and a case internal space defined between the bottom plate portion and the surrounding wall portion; the surrounding wall portion of the case member being provided with a plurality of retaining holes corresponding to the stop protrusions on the outer stop wall of the frame member; and the surrounding wall portion being designed for extending into the insertion space on the frame member, such that the inner stop wall is located in the case internal space of the case member and the stop protrusions on the inner side surface of the outer stop wall are aligned with and enter the retaining holes on the surrounding wall portion in one-to-one correspondence;

two lining structures respectively including a lining main body and a lining spline; the lining spline being wrapped in an edge of the lining main body to be connected to the lining main body and located in the case internal space; and the lining spline being shaped to be removably snap-fittable in the lining retaining hooks on the enclosed frame of the shell structure; and a zipper structure including two zipper tapes respectively connected to one of the two shell structures and a slider for closing or separating the two zipper tapes; and the zipper tapes respectively including a plurality of embedding teeth embedded in the enclosed frame and a plurality of closure teeth exposed from the shell structure, such that the two shell structures are connected to each other by closing the closure teeth on the two zipper tapes.

2. The snap-fit suitcase as claimed in claim 1, wherein the outer stop wall is deformable relative to the enclosed frame; and the surrounding wall portion of the case member, when being extended into the insertion space, being adapted to press against and push the stop protrusions to displace, and the stop protrusions causing the outer stop wall to deform in a direction away from the inner stop wall.

3. The snap-fit suitcase as claimed in claim 1, wherein one side of each of the stop protrusions facing away from the outer stop wall is formed into a slanted stop protrusion guiding surface that is adapted to contact with the surrounding wall portion of the case member; and the surrounding wall portion of the case member being guided by the stop protrusion guiding surface to a location between the stop protrusions and the inner stop wall, enabling the surrounding wall portion to keep moving into the insertion space.

4. The snap-fit suitcase as claimed in claim 3, wherein the slanted stop protrusion guiding surface has a lowermost section that is defined as a lower guiding section and an uppermost section that is defined as an upper guiding section located at a height higher than that of the lower guiding section; and the lower guiding section being located in one corresponding retaining hole, and the upper guiding section being protruded beyond the corresponding retaining hole and located outside the case internal space.

5. The snap-fit suitcase as claimed in claim 4, wherein the inner stop wall includes a plurality of inner wall segments spaced along the enclosed frame, such that a division space is formed between any two adjacent inner wall segments; and the division spaces being located in one-to-one correspondence to the stop protrusions, and the upper guiding sections being respectively located in one corresponding division space.

6. The snap-fit suitcase as claimed in claim 3, wherein a portion on each of the stop protrusion guiding surfaces is sunken to form a stop protrusion recess for communicating with the insertion space.

7. The snap-fit suitcase as claimed in claim 1, wherein the enclosed frame further includes a stop strip located above the lining retaining hooks, such that a clamp space is formed between the stop strip and the lining retaining hooks; and the stop strip and the lining retaining hooks together limiting the lining spline in the clamp space.

8. The snap-fit suitcase as claimed in claim 7, wherein the stop strip has a width larger than a length of the lining retaining hook; the stop strip being formed with a plurality of through holes, and the through holes respectively have a profile larger than that of the lining retaining hook and are located in one-to-one correspondence to the lining retaining hooks.

9. The snap-fit suitcase as claimed in claim 1, further comprising a shield structure, the shield structure includes a shield cover and a plurality of shield hooks provided on the shield cover; a first part of the shield hooks being snap-fitted onto the enclosed frame of one of the two frame members while a second part of the shield hooks being snap-fitted onto the enclosed frame of the other frame member, such that the shield cover is adapted to cover part of the zipper tapes.

10. The snap-fit suitcase as claimed in claim 9, wherein the shield cover includes two assembling sections that spacing each other parallelly and a bendable section extended between and connected to the two assembling sections; the first part of the shield hooks being formed on one of the two assembling sections while the second part of the shield hooks being formed on the other assembling section; and the bendable section being deformable to thereby allow change of a position of one assembling section relative to the other assembling section.

11. The snap-fit suitcase as claimed in claim 10, wherein the enclosed frames are symmetrically formed on an outer side at a predetermined location with a shield receiving recess for receiving the assembling sections of the shield covers therein; and the shield receiving recesses having a depth larger than or equal to a thickness of the assembling sections, such that the assembling sections are located lower than or flush with the outer side of the enclosed frames.

12. The snap-fit suitcase as claimed in claim 9, wherein the shield receiving recesses on the enclosed frames have a plurality of hook receiving holes that extending through the enclosed frames; the shield hooks respectively including an extension section located in a corresponding one of the hook receiving holes and a snap-fit section extended from and located perpendicular to a distal end of the extension section; the snap-fit section being projected beyond the hook receiving holes and then dislocated relative to the hook receiving holes to thereby contact with the inner side of the enclosed frames.

13. The snap-fit suitcase as claimed in claim 12, wherein the extension section of the shield hook is deformable relative to the shield cover, and when the shield hook is extended into the hook receiving hole, the snap-fit section of the shield hook is pressed against an outer side of the enclosed frame to cause deformation of the extension section; and the deformed extension section enabling the snap-fit section to move to an inner side of the hook receiving hole.

14. The snap-fit suitcase as claimed in claim 12, wherein the snap-fit section of the shield hook includes a hook guiding surface, and the shield hook being guided by the hook guiding surface into the hook receiving hole.

15. The snap-fit suitcase as claimed in claim 1, wherein the frame members are integrally formed on the embedding teeth of the zipper tapes through plastic insert molding.

* * * * *